United States Patent [19]

Anstine et al.

[11] Patent Number: 4,512,921

[45] Date of Patent: Apr. 23, 1985

[54] NUCLEAR REACTOR COOLING SYSTEM DECONTAMINATION REAGENT REGENERATION

[75] Inventors: Larry D. Anstine, San Jose; Dean B. James, Saratoga; Edward A. Melaika, Berkeley; John P. Peterson, Jr., Livermore, all of Calif.

[73] Assignee: The United States of America as represented by the United States Department of Energy, Washington, D.C.

[21] Appl. No.: 420,464

[22] Filed: Sep. 20, 1982

Related U.S. Application Data

[63] Continuation of Ser. No. 156,945, Jun. 6, 1980, abandoned.

[51] Int. Cl.[3] ..... G21F 9/28; G21C 19/30

[52] U.S. Cl. ..... 252/626; 134/3; 252/631

[58] Field of Search ..... 252/626, 631; 134/3

[56] References Cited

U.S. PATENT DOCUMENTS 3,664,870 5/1972 Oberhofer et al. ..... 134/3

4,287,002 9/1981 Torok ..... 134/3

FOREIGN PATENT DOCUMENTS 1062590 9/1979 Canada .

*Primary Examiner*—Deborah L. Kyle

*Attorney, Agent, or Firm*—Jeannette M. Walder; James W. Weinberger; Judson R. Hightower

[57] ABSTRACT

An improved method for decontaminating the coolant system of water-cooled nuclear power reactors and for regenerating the decontamination solution. A small amount of one or more weak-acid organic complexing agents is added to the reactor coolant, and the pH is adjusted to form a decontamination solution which is circulated throughout the coolant system to dissolve metal oxides from the interior surfaces and complex the resulting metal ions and radionuclide ions. The coolant containing the complexed metal ions and radionuclide ions is passed through a strong-base anion exchange resin bed which has been presaturated with a solution containing the complexing agents in the same ratio and having the same pH as the decontamination solution. As the decontamination solution passes through the resin bed, metal-complexed anions are exchanged for the metal-ion-free anions on the bed, while metal-ion-free anions in the solution pass through the bed, thus removing the metal ions and regenerating the decontamination solution.

8 Claims, 2 Drawing Figures

PRE-EQUILIBRATED ANION EXCHANGE RESINS.

PRE-EQUILIBRATED ANION EXCHANGE RESINS.

CATION-EXCHANGE RESIN
METAL ION CONCENTRATION (% OF FEED)
120
90
60
30
0
0
200
600
1000
1400
1800
VOLUME (Bed - void volumes)
Iron
Cobalt 60

NUCLEAR REACTOR COOLING SYSTEM DECONTAMINATION REAGENT REGENERATION

CONTRACTUAL ORIGIN OF THE INVENTION

The United States Government has rights in this invention pursuant to Contract No. EY-76-C-02-2985 between the U.S. Department of Energy and General Electric.

This is a continuation of application Ser. No. 156,945, filed June 6, 1980, now abandoned.

BACKGROUND OF THE INVENTION

This invention relates to a method for chemically decontaminating water-cooled nuclear power reactor coolant systems. More specifically, this invention relates to a method for regenerating the reagents used for the chemical decontamination of the primary coolant systems of water cooled nuclear power reactors.

In nuclear reactors cooled by water, the primary materials of construction, that is, stainless steel, carbon steel, and Inconel, are continuously corroding at an extremely low rate to form corrosion products such as $Fe_2O_3$ and $Fe_3O_4$. A percentage of these corrosion products are sloughed or leached from the corroding surfaces and the majority are deposited on the surface of the fuel cladding in the reactor core. Here, the corrosion products become radioactive by bombardment with neutrons from the fuel. The corrosion products, which now contain radioactive isotopes, are carried from the core by the circulating coolant and are redeposited on other surfaces of the cooling system in areas where they can expose workers in the power plant to radiation.

The presence of a radiation field around out-of-reactor equipment complicates maintenance and repair due to the need to minimize the exposure of the workers to the radiation. It is therefore desirable to reduce this radiation exposure to levels that are as low as reasonably achievable. One obvious method of accomplishing this reduction is to reduce the source of the exposure. Periodic decontamination of the primary coolant system of nuclear reactors appears to offer a practicable approach to control of the radiation exposure levels of personnel.

A method for decontaminating nuclear reactor coolant systems using a dilute chemical decontamination concept was developed by Atomic Energy of Canada, Ltd. The process known as CAN-DECON, is described in J. Br Nucl. Energy Soc., 1977, 16 Jan., No. 1, pages 53–61. As explained therein, a proprietary mixture of organic acids is added to the reactor coolant to form a 0.1% solution, and this solution is circulated throughout the reactor. The acids dissolve the oxide films and embedded radionuclides from the metal surfaces of the cooling system. The chelated metals are then transported by the circulating coolant to cation exchange resins in the purification system where the metals are removed, the organic acids regenerated, and the solution recirculated for further decontamination. When decontamination is complete, the coolant is passed through a mixed bed of cation- and anion-exchange resins to remove the reagents and any remaining dissolved metals from the coolant. Any solid material remaining in the coolant is removed by filters.

There are a number of advantages attendent to the use of this type of system. For example, since the coolant is used as the solvent for the decontamination reagents, the system does not need to be drained and the fuel can be decontaminated simultaneously. Since only very low concentrations of decontaminants are added to and removed from the coolant, corrosion of the coolant system is slight. The decontamination process can be continued as long as activity is still being removed since the organic acid reagents are being continuously regenerated. All wastes are concentrated on ion-exchange resins, which simplifies disposal. Also, no large storage tanks are required.

While this particular process works very well in heavy water reactors, it is not directly applicable to boiling water reactors (BWR) because the quantities of corrosion products (metal oxides) and radionuclides present on the fuel and out-of-core surfaces of BWR have been estimated to be as much as 100 times greater than the quantities that must be removed during heavy-water cooling system decontaminations.

In a dilute-chemical decontamination process, the concentrations of dissolved (complexed) metal ions (primarily $Fe^{+3}$ and $Fe^{+2}$) and radioactive ions (primarily $Co^{+2}$) increase as the corrosion-product oxides are dissolved. When the concentration of dissolved metal ions approaches the complexing capacity of the organic acids, the dissolution rate decreases and the decontamination process becomes very inefficient and is, therefore, effectively terminated. Furthermore, if the concentrations of the metal-ion complexes exceed their solubility limits, precipitation of these radioactive compounds can occur; these precipitates can settle in dead-legs and low-flow regions, creating future operational problems.

It is therefore necessary to continuously remove the metallic ions as they are generated. This can be accomplished by continuously circulating some of the decontamination coolant through a regenerating ion exchange system that removes the metallic-ions without removing the organic chemicals.

In the prior art process, cation-exchange resin is utilized for the continuous regeneration of the dilute reagents which are thought to be a mixture of oxalic acid, citric acid, and ethylenediaminetetraacetic acid (EDTA). The regeneration process works adequately for the removal of the divalent ions (such as $Fe^{+2}$ and $Co^{+2}$) from the oxalate and citrate complexes. THis occurs because the divalent-ion complexes are so weak that chemical equilibria for the divalent ions favors the cation-exchange resin over the organic complex. However, the $Fe^{+3}$ complexes with oxalate and citrate are considerably stronger, so that only a small fraction of the $Fe^{+3}$ ion is removed by the cation-exchange resin. Furthermore, all of the EDTA-metal-ion complexes are sufficiently strong to prevent regeneration of EDTA with cation-exchange resin. In the heavy-water reactor decontaminations which have been performed, this inability to remove $Fe^{+3}$ ions from their complexes has not been a significant problem due to the low quantities of corrosion products which accummulate in these reactors. However, in reactors where the quantities of corrosion products are considerably higher, a technique for removing the $Fe^{+3}$ from the metal-ion complexes is needed to provide adequate complexing capacity without increasing the quantities of reagents which would lead to higher waste volumes and other problems.

SUMMARY OF THE INVENTION

An improved method has been developed for regenerating dilute aqueous solutions of weak-acid organic complexing agents used in the decontamination of the cooling systems of water-cooled nuclear reactors. The method provides the capability of regenerating complexes of $Fe^{+3}$ ions and also provides for the more efficient removal from the decontamination solution of divalent metallic ions (particularly $^{60}Co^{+2}$, the primary radionuclide) from their oxalate and citrate complexes. It is therefore the invention to provide an improved method for regenerating dilute aqueous solutions of weak-acid organic complexing agents that have been added to the coolant of nuclear power reactors for the purpose of decontaminating the coolant system after some of the agents have complexed divalent and trivalent metal ions. The invention is practiced by presaturating an anion-exchange resin bed with the anions of the organic acid complexing agents so that these reagents on the resin are in chemical equilibrium with the reagents agents present in the coolant, and the solution in the resin bed is at about the same pH; and by passing the coolant containing the complexed metal ions through the bed, wherein the complexed divalent and trivalent metal ions are exchanged for the metal-ion-free organic anions on the resin bed and the liberated organic-acid anions pass through the bed unaffected thereby removing the complexed metal ions from the coolant and regenerating the complexing agents; and finally by recirculating the coolant containing the regenerated complexing agents through the coolant system.

The advantage of the invention is that it allows the application of dilute chemical decontamination technology to boiling water reactors at reasonable reagent concentrations, and it provides maximum utilization of the complexing organic acids.

It is therefore one object of the invention to provide an improved method for the chemical decontamination of the coolant systems of water-cooled nuclear power reactors.

It is another object of the invention to provide a method for regenerating the reagents used for the chemical decontamination of the coolant systems of water cooled nuclear reactors.

It is still another object of the invention to provide an improved method for regenerating dilute solutions of organic acid complexing agents used for the chemical decontamination of the coolant systems of water-cooled nuclear reactors.

Finally, it is the object of the invention to provide an improved method for regenerating dilute solutions of oxalic acid and citric acid contained in the coolant and used for the chemical decontamination of nuclear reactor coolant systems.

DETAILED DESCRIPTION OF THE PREFERRED EMBODIMENT

Figure 1:
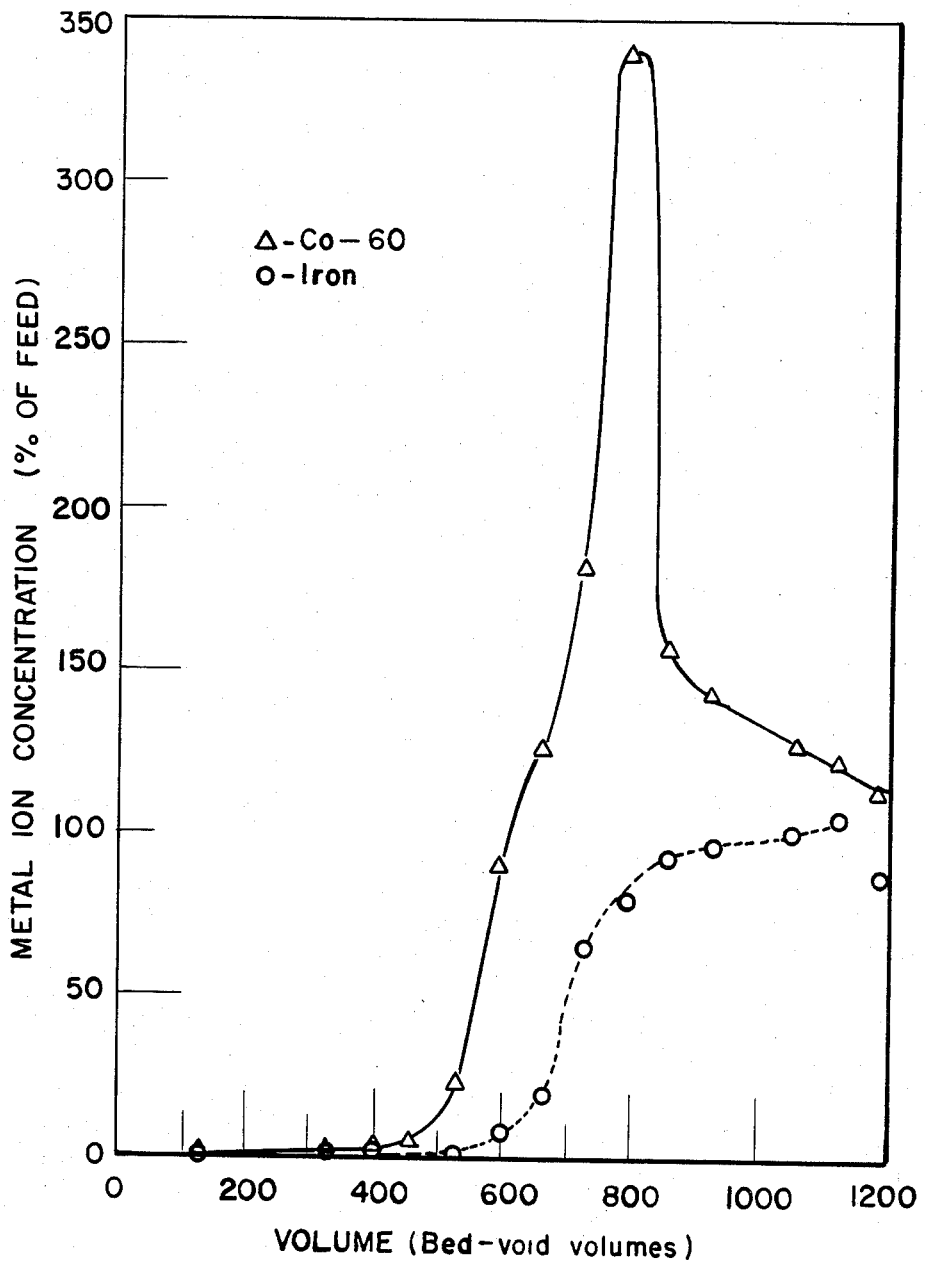
FIG. 1 is a graph showing the removal of contaminants from a 0.02M oxalic acid solution by a presaturated anion-exchange resin.
Figure 2:
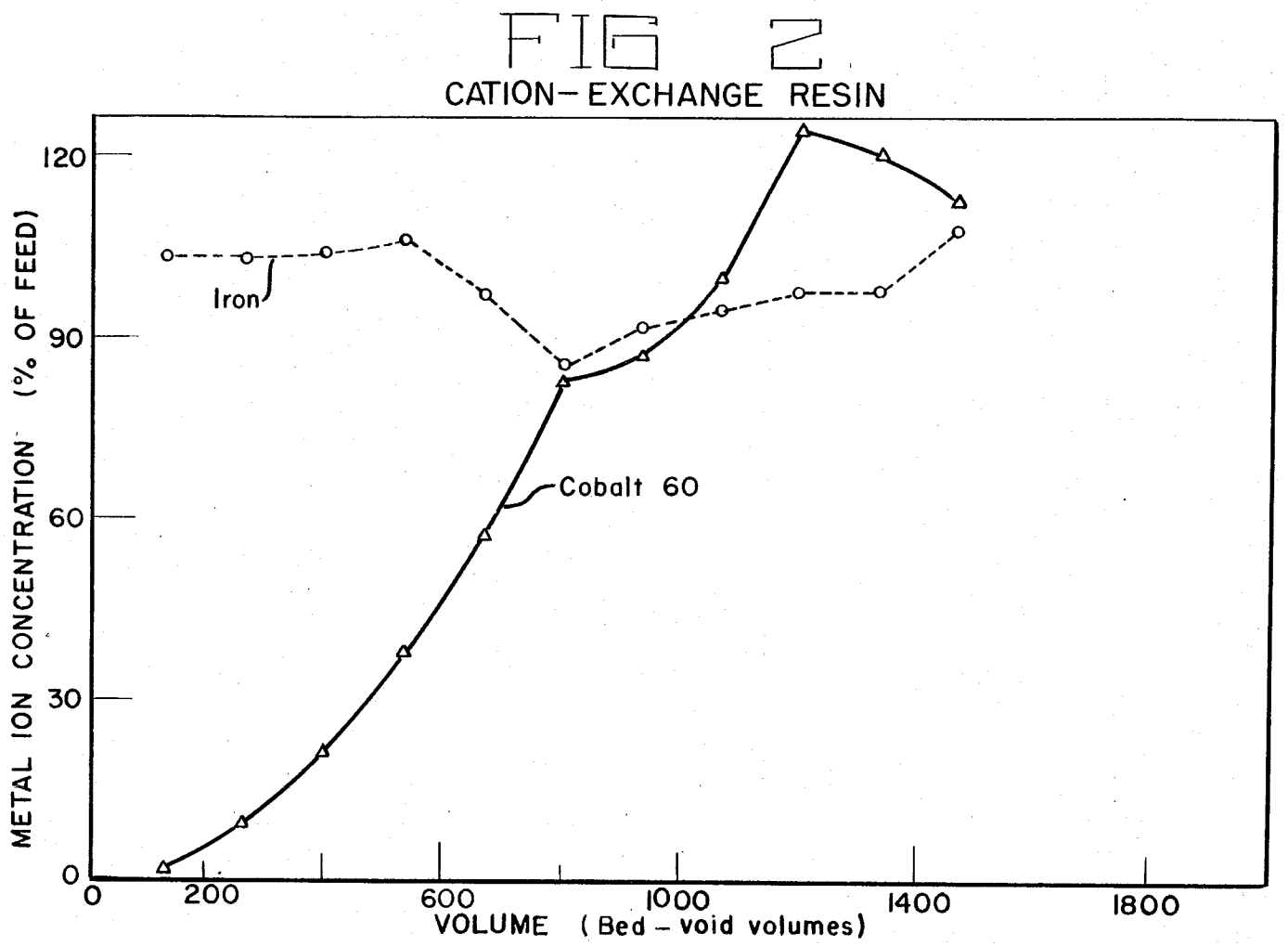
FIG. 2 is a graph showing the removal of contaminants from a 0.02M oxalic acid solution by hydrogen-ion-form cation exchange resin.

In order to decontaminate the coolant system of a water cooled nuclear power reactor, the reactor must first be shut down and the coolant allowed to cool below 100° C. The decontamination solution is prepared by adding concentrated solutions to the coolant to make the coolant about 0.01M in oxalic acid and about 0.005M in citric acid, by adjusting the pH to about 3 with ammonia, and by adding and maintaining about 0.75 ppm dissolved oxygen in the coolant. The decontamination solution is then circulated at a temperature of about 90° C., throughout the coolant system. As the decontamination solution circulates, the metal oxide films on the surface of the system dissolve and are complexed by the oxalic acid and to a lesser extent by the citric acid. In addition to the complexed metal ions, other particulate matter may be loosened and swept along by the decontamination solution. As the decontamination process proceeds, the dissolved metallic ions are continuously removed and the complexing power of the reagents renewed by passing a portion of the coolant containing the metal-ion complexes through a strong-base anion-exchange resin bed which has been presaturated with oxalic and citric acids in about the same ratio and about the same pH as these reagents are present in the circulating coolant. As the contaminated decontamination solution, which contains a mixture of unutilized or metal-ion-free organic anions and complexed divalent and trivalent metal ions, is passed through the presaturated anion-exchange resin bed wherein the metallic-ion complexes are exchanged for the metal-ion-free organic anions on the resin while any unutilized, metal-ion-free organic anions pass through the resin bed unaffected, whereby this portion of the decontamination solution is renewed and is ready for recirculation throughout the cooling system.

The coolant may be made from 0.005 to 0.02M in oxalic acid with about 0.01M being the preferred concentration; lower concentrations result in much slower dissolution rates. Citric acid concentration may vary from about 0.002 to 0.01M with 0.005M being the preferred concentration. The ratio of oxalic acid to citric acid may vary from 1:1 to 10:1 with a ratio of about 2:1 preferred. The citric acid acts as a pH buffer and to retard the formation of ferrous oxalate which may otherwise precipitate and may be difficult to resolubilize. The citric acid may also act as a minor complexing agent. The oxalic and citric acids may be injected together or separately into the coolant as concentrated solutions.

The pH of the coolant may vary from about 2.5 to 4.0, preferably 2.8 to 3.5 and most preferably about 3.0 and may be controlled by adjusting the pH with ammonia. Control of pH is important to obtain the highest dissolution rate with the minimum amount of corrosion.

Coolant temperature during decontamination may vary from about 60° to 100° C. with 90° C. being preferred. Temperatures above 100° C. cause the organic reagents to decompose while below about 60° C. the dissolution rate is very slow.

A small amount of dissolved oxygen should also be added to the circulating coolant during decontamination to ensure complete oxidation of the $Fe^{+2}$ to $Fe^{+3}$. This is important to prevent formation of ferrous oxalate precipitate. The concentration of oxygen may vary from about 0.2 to 4.0 ppm, preferably about 0.5 to 1.0 ppm. The oxygen may be added by any convenient method, such as the addition of hydrogen peroxide to the coolant, or preferably, by gas injection into one of the flowing coolant systems.

The anion-exchange resin may be any commercially available strong base anion exchange resin such as Bio Rad AG-1 or Amberlite IR-400. The resin, which is generally received in hydroxide form must be loaded with oxalate and citrate anions so that the anions on the resin are in chemical equilibrium with the reagents in the decontamination solution. This can best be accomplished by first loading the organic anion on the resin bed from a concentrated solution of the reagents. The resin can then be equilibrated in a stepwise matter with a dilute flushing solution of the same composition as the decontamination solution until the effluent from the bed has about the same concentration of reagents and pH as the decontamination solution. For example, a concentrated oxalic acid-citric acid solution is prepared in which the oxalate-citrate ratio is the desired ratio of the two reagents on the resin when it is in chemical equilibrium with the decontamination solution. This concentrated solution is added to the resin at a controlled rate until the pH is about that desired for the decontamination solution. A dilute oxalic acid-citric acid flushing solution is prepared having the same composition and pH as the decontamination solution. The resin is then flushed in a column with large quantities of the flushing solution until the effluent is the same pH as the decontamination solution. At this time the resin is presaturated and ready for use in regenerating the reagents in the coolant.

When the coolant decontamination solution, containing a mixture of the unutilized metal-ion free organic anions and the metallic-ion complexes, is passed through the presaturated anion-exchange resin, the metallic-ion complexes are exchanged for the metal-ion-free organic ions in the resin. The unutilized reagents pass through the resin bed unaffected. Using oxalic acid as an example, the exchange reactions for the $Fe^{+3}$ oxalate and $Co^{+2}$ oxalic complexes are:

$$Fe(C_2O_4)_3^{-3}+3RHC_2O_4 \rightarrow R_3Fe(C_2O_4)_3+3HC_2O_4^-,$$

and $$Co(C_2O_4)_2^{-2}+2RHC_2O_4 \rightarrow R_2Co(C_2O_4)_2+2HC_2O_4^-,$$

where R stands for the cationic species affixed to molecular structure of the resin. Although these are reversible, equilibirum reactions, they are driven to the right by the thermodynamic preference of the resin for the multicharged metallic-complex ion over the single-charged binoxalate anion and by the multistage sorption effect of the anion-exchange column.

The decontamination reagents can be easily removed from the reactor coolant system by passing the coolant containing the reagents, either complexed or uncomplexed through a mixed ion-exchage resin bed, i.e. both anion- and cation-exchange resins, until the conductivity of the solution drops to about 1 μmho. At this point, the coolant is essentially free of reagent and reactor start-up can be commenced.

While the method of the invention as described, is applied only to the regeneration of oxalic acid and citric acid systems, the technology could potentially be applied to the regeneration of solutions of a variety of other metal complexing organic chemicals which might be used as decontaminating agents. These include nitrilotriacetic acid (NTA) and hydroxyethylethylenediaminetriacetic acid (HEDTA).

The addition of a small amount (5 to 10% by volume) of cation-exchange resin to the presaturated anion-exchange resin could potentially provide a margin of additional capacity for the removal of divalent ions. Since the cation-exchange resin does not sorb appreciable amounts of $Fe^{+3}$ from oxalate and citrate solutions, its capacity for removing the divalent metallic ions from the decontaminating solution is essentially independent of the $Fe^{+3}$ concentration. Thus, even though it is less efficient initially than the anion-exchange resin for the removal of divalent ions, the cation-exchange resin may become more efficient as the anion-exchange resin reaches saturation with the $Fe^{+3}$ complexes.

EXAMPLE I

To compare the effectiveness of the anion- and cation-exchange resins on the removal of iron and cobalt from a decontamination solution, a typical laboratory ion-exchange column (1 cm×30 cm) was loaded with strong-base anion-exchange resin (Bio Rad AG-1) to a height of 20 cm. To presaturate the resin, a solution of 0.02M oxalic acid, adjusted to a pH of 3.0 with $NH_4OH$, was passed through the column until the column effluent had the same concentration and pH as the feed. A simulated decontamination solution, consisting of 0.02M oxalic acid with $1.51\times10^{-3}$M $Fe^{+3}$ and $4.0\times10^{-5}$M $Co^{+2}$ ($6.8\times10^{-3}$ μCi/ml Co-60), was passed through the column, and the effluent was sampled periodically. The effluent samples were analyzed for the concentrations of $Fe^{+3}$ and Co-60.

The $Fe^{+3}$ and Co-60 concentrations in the effluent are shown in FIG. I. The anion-exchange resin, presaturated with binoxalate anions, was essentially 100% efficient at removing Co-60 for about 500 bed-void volumes and at removing $Fe^{+3}$ for about 550 bed-void volumes. This demonstrates the efficiency of the anion-exchange process for removing the metallic-ion complexes from the solution.

Similar experiments to evaluate the cation regeneration process were conducted with hydrogen-ion-form cation-exchange resin and a pH 3 solution of 0.02M oxalic acid with $1.55\times10^{-3}$M $Fe^{+3}$ and $5.7\times10^{-5}$M $Co^{+2}$ ($7.7\times10^{-3}$ μCi/ml Co-60). The results of the $Fe^{+3}$ and Co-60 are plotted in FIG. II. These data readily indicate that the $Fe^{+3}$-oxalate complex is not efficiently removed by cation-exchange resin (breakthrough after about one bed-void volume) and efficiency of the cation-exchange resin for removal of $Co^{+2}$ decreases after only about 150 bed-void volumes of solution is passed through the column. This premature cobalt breakthrough occurred even though the ion-exchange column was not saturated with the metallic ions.

EXAMPLE II

An anion exchange resin was presaturated with oxalate and citrate anion in the following manner: A concentrated solution of oxalic acid and citric acid was prepared by dissolving 83.6 g oxalic acid and 33.5 g in citric acid in 1070 ml $H_2O$ to form a solution 0.62M in oxalate and 0.149M in citrate. The concentrated solution was added to a beaker containing 780 ml of a strong base anion resin in the $OH^-$form at a controlled rate of 12 ml/min and stirred, until a pH of 3 was achieved. This required about 625 ml of solution. The resin was then loaded into a standard ion exchange column and flushed with a solution of 0.012M oxalic acid and 0.005M citric acid at pH3 until the column effluent had about the same pH and oxalate-citrate concentration as the flushing solution. Table I below shows the correlation between solution volume and oxalate-citrate concentration.

TABLE I

| Total Solution Volume ml | pH | Oxalate-Citrate Concentration |
|---|---|---|
| 800 | 4.11 | Not Determined |
| 6200 | 4.10 | Not Determined |
| 18200 | 3.43 | Oxalate-0.0085 M Citrate-0.008 M |
| 29900 | 3.19 | Not Determined |
| 40900 | 2.98 | Oxalate-0.0116 M Citrate 0.0049 M |

The resin was then presaturated and ready for regeneration of the decontamination solution.

EXAMPLE III

An ion-exchange column breakthrough experiment was conducted to evaluate the elution sequence and the capacity of a mixed-bed of cation and presaturated anion resin used for the regeneration process. A solution of 0.01M oxalic acid and 0.005M citric acid at pH 3 containing 0.003M $Fe^{+3}$ and 0.0001M $Cr^{+3}$, $Ni^{+2}$, $Co^{+2}$, $Zn^{+2}$, $Mn^{+2}$, $Cu^{+2}$, and $Fe^{+2}$ was passed through a 90/10 mixture of anion and cation resins until the effluent and feed concentrations were similar. The effluent was sampled periodically and analyzed for metal ion concentrations by plasma spectrometry; the $Fe^{+2}$ concentrations were determined spectrophotometrically.

The elution sequence was ($Fe^{+3}$,$Cr^{+3}$), $Cu^{+2}$, ($Ni^{+2}$, $Zn^{+2}$, $Co^{+2}$), $Mn^{+2}$ and $Fe^{+2}$, which is in agreement with the oxalate complex stabilities for the various ions. These data indicate the quantity of cation resin added to the pre-saturated anion resin to provide back-up Co-60 capacity for the regeneration process must have sufficient capacity to adsorb all of the divalent corrosion products except Cu. In addition, these data indicated the $Fe^{+3}$ and $Cr^{+3}$ oxalate complexes have similar affinities for the anion-exchange resin since their breakthroughs occurred simultaneously and their final concentrations on the resin were proportional to their solution concentrations.

The capacity of the presaturated anion-exchange resin for trivalent ions was determined to be 0.47 moles/liter, which is equivalent to the theoretical capacity. The capacity of the cation-exchange resin for divalent-ions was determined to be 0.33 moles/liter, which is approximately 40% of the theoretical capacity.

EXAMPLE IV

A circulating test loop was prepared to study the effects of the decontamination reagents on the removal of iron oxides and cobalt from reactor coolant system piping and to determine the efficiency of the reagent regeneration. A solvent consisting of 0.01M oxalic acid and 0.005M citric acid at pH3 was circulated through the loop. The dissolved oxygen content of the solvent was maintained within the specification of 0.75±0.25 ppm. No ferrous oxalate precipitation was observed. Approximately 85% of the Co-60 activity was removed over the 12-hour dissolution cycle.

Within a few minutes after the initial injection of the reagents, the loop chemistry and operating conditions were stabilized. All of the operating parameters were maintained within specification for the remainder of the run. The Co-60 activity in solution increased to a maximum during the first few hours of the test and then it decreased as the oxide film dissolution rate decreased and was exceeded by the solvent regeneration rate. The maximum Co-60 concentration obtained was equal to approximately 6.7% of the total Co-60 dissolved during the test.

The oxalic acid and citric acid concentrations were maintained within specification during the decontamination cycle. The iron concentration in solution was maintained below 6% of the total iron dissolved.

As can be seen from the preceeding discussion and Examples, the process of this invention provides an effective method for the decontamination of the coolant systems of water cooled nuclear power reactors by providing an efficient and effective method for continuously regenerating the reagents used for the decontamination process.

The embodiments of the invention in which an exclusive property or privilege is claimed are defined as follows:

1. A method of removing corrosion products from the coolant system of a water-cooled nuclear reactor comprising the steps of:

(a) adding at least one soluble weak-acid organic complexing agent selected from the group consisting of oxalic acid, citric acid, nitrilotriacetic acid and hydroxyethylethylenediaminetriacetic acid to the coolant to form a decontamination solution;

(b) adjusting the pH of the decontamination solution to from 2.5 to 4.0;

(c) circulating and decontamination solution at a temperature of from 60° to 100° C. throughout the coolant system to dissolve the corrosion products to form a complexed ion solution of $Fe^{+2}$, $Fe^{+3}$, $^{60}Co^{+2}$, and other metal ion complexes; and (d) removing the $Fe^{+2}$, $Fe^{+3}$ and $^{60}Co^{+2}$ complexes from the complexed ion solution and regenerating the decontamination solution by passing the complexed ion solution through an anion exchange resin, said anion exchange resin having been presaturated with the anions of the weak-acid organic complexing agent of the decontamination solution such that the concentration of the agents on the resin is substantially the same concentration of the agents in the decontamination solution and having the same pH of the decontamination solution.

2. The method of claim 1 wherein the decontamination solution contains from 0.2 to 4.0 ppm dissolved oxygen.

3. The method of claim 2 wherein the weak-acid organic complexing agents comprise from 0.005 to 0.02M in oxalic acid and from 0.002 to 0.01M in citric acid.

4. The method of claim 1 wherein the nuclear reactor is a boiling water reactor.

5. The method of claim 1 further comprising the step of recirculating the regenerated decontamination solution through the coolant system.

6. In the method of removing corrosion products from the coolant system of a water-cooled nuclear reactor by:

(a) adding at least one soluble weak-acid organic complexing agent selected from the group consisting of oxalic acid, citric acid, nitrilotriacetic acid and hydroxyethylethylenediaminetriacetic acid to the coolant to form a decontamination solution;

(b) adjusting the pH of the decontamination solution to from 2.5 to 4.0;

(c) circulating the decontamination solution at a temperature of from 60° to 100° C. throughout the coolant system to dissolve the corrosion products to form a complexed ion solution of $Fe^{+2}$, $Fe^{+3}$, $^{60}Co^{+2}$, and other metal ion complexes; and (d) passing the complexed ion solution through a cation exchange resin;

wherein the improvement comprises:

replacing the cation exchange resin with a pretreated anion exchange resin, said pretreated anion exchange resin having been presaturated with the anions of the weak-acid organic complexing agent of the decontamination solution such that the concentration of the agents in the resin is substantially the same concentration of the agents in the decontamination solution and having the same pH of the decontamination solution, whereby passing the complexed ion solution through the pretreated anion exchange resin removes the $Fe^{+2}$, $Fe^{+3}$, and $^{60}Co^{+2}$ ions from the complexed ion solution and regenerates the decontamination solution.

7. The method of claim 6 further comprising the step of recirculating the regenerated decontamination solution through the coolant system.

8. The method of claim 5 or 7 further comprising the step of purifying the coolant system to remove the organic complexing agents and any metal ion complexes remaining in the system by passing the regenerated decontamination solution through a mixed-bed of anion and cation exchange resins.

* * * * *